US007714718B2

(12) United States Patent
DiPoala et al.

(10) Patent No.: US 7,714,718 B2
(45) Date of Patent: May 11, 2010

(54) OPTICAL SECURITY SENSOR FOR A DOOR

(75) Inventors: William S. DiPoala, Fairport, NY (US); David Anderson, Rochester, NY (US); Jeffrey Swan, Rochester, NY (US)

(73) Assignee: Robert Bosch GmbH, Stuttgart (DE)

( * ) Notice: Subject to any disclaimer, the term of this patent is extended or adjusted under 35 U.S.C. 154(b) by 319 days.

(21) Appl. No.: 11/782,673

(22) Filed: Jul. 25, 2007

(65) Prior Publication Data

US 2009/0027198 A1 Jan. 29, 2009

(51) Int. Cl.
*G08B 13/08* (2006.01)

(52) U.S. Cl. ..... 340/545.3; 340/545.2; 340/545.1

(58) Field of Classification Search ..... 340/545.1, 340/545.2, 545.3, 545.6, 555, 556, 557; 250/221, 250/222.1, 214 B; 318/466
See application file for complete search history.

(56) References Cited

U.S. PATENT DOCUMENTS 3,987,428 A 10/1976 Todeschini
5,508,511 A 4/1996 Zur et al.
5,912,619 A * 6/1999 Vogt ..... 340/545.1
5,936,522 A * 8/1999 Vogt ..... 340/545.1
6,157,024 A * 12/2000 Chapdelaine et al. ..... 250/221
6,962,239 B2 11/2005 Shikai et al.
7,491,926 B1 * 2/2009 Anderson et al. ..... 250/221
2002/0196155 A1 12/2002 McNulty
2005/0133699 A1 6/2005 Miremadi
2007/0214812 A1 * 9/2007 Wagner et al. ..... 62/129

* cited by examiner

*Primary Examiner*—Van T. Trieu
(74) *Attorney, Agent, or Firm*—Sarah L. Taylor, Esq.

(57) ABSTRACT

A security assembly includes a first building structure at least partially defining a building opening. The first building structure has a first surface. A movable building structure is movable between a closed position in which the movable building structure covers the opening and an open position in which the movable building structure uncovers the opening. The movable building structure has a perimeter with a second surface disposed in opposition to the first surface when the movable building structure is in the closed position. An optical sensor apparatus includes an electronics module mounted in association with the first surface or the second surface. The electronics module has an optical emitter and an optical receiver. The optical emitter emits a first beam. A reflector arrangement is mounted in association with the other of the first surface and the second surface. The reflector arrangement provides a plurality of sequential reflections of the first beam to thereby produce a second beam directed at the optical receiver.

20 Claims, 6 Drawing Sheets

OPTICAL SECURITY SENSOR FOR A DOOR

BACKGROUND OF THE INVENTION

1. Field of the Invention

The present invention relates to surveillance system sensors, and, more particularly, to surveillance system sensors for detecting the opening of a door or window.

2. Description of the Related Art

Surveillance systems, also known as security systems, are known to include door sensors for monitoring the opening and closing of a door. Door sensors are known to be in the form of a pushbutton that is held in a depressed state by the door when the door is in a closed position. When opening, the door moves away from the pushbutton, thereby releasing the pushbutton from the depressed state. A controller monitors the state of the pushbutton, and may issue an alarm signal if the door is opened without authorization. A problem with this type of sensor is that an intruder can defeat it by inserting a thin object, such as a piece of sheet metal, between the door and the pushbutton such that the object holds the pushbutton in a depressed state when the door is opened. Thus, the controller cannot detect that the door has been opened.

Another type of door sensor is the magnetic reed switch type that includes a reed switch sensor mounted on the door frame. The sensor detects and monitors the presence of a magnet that is mounted on the door at a location that is adjacent to the sensor when the door is in the closed position. Thus, the magnet may be detected by the sensor only when the door is closed. A problem with this type of sensor is that it too may be defeated by an intruder. For example, the intruder may attach another magnet adjacent to the reed switch sensor before opening the door such that the sensor's detection of the presence of a magnet is uninterrupted. Here too, the sensor, and a controller connected to the sensor, cannot detect that the door has been opened.

What is needed in the art is a door/window sensor that cannot be easily defeated by an intruder and that can be incorporated into a security system.

SUMMARY OF THE INVENTION

The present invention provides a door sensor having a first part that may be mounted on a door frame or on a door, and that includes an optical emitter and an optical receiver. A second part of the door sensor may be mounted on the other one of the door frame and the door, and includes a reflector arrangement that reflects an optical beam from the emitter back to the receiver. The reflected beam received by the receiver may be laterally offset from and substantially parallel to the beam as provided by the emitter.

The invention comprises, in one form thereof, a security assembly including a first building structure at least partially defining a building opening. The first building structure has a first surface. A movable building structure is movable between a closed position in which the movable building structure covers the opening and an open position in which the movable building structure uncovers the opening. The movable building structure has a perimeter with a second surface disposed in opposition to the first surface when the movable building structure is in the closed position. An optical sensor apparatus includes an electronics module mounted in association with the first surface or the second surface. The electronics module has an optical emitter and an optical receiver. The optical emitter emits a first beam. A reflector arrangement is mounted in association with the other of the first surface and the second surface. The reflector arrangement provides a plurality of sequential reflections of the first beam to thereby produce a second beam directed at the optical receiver.

The invention comprises, in another form thereof, a security sensor apparatus for sensing movement of an object. An electronics module includes an optical emitter and an optical receiver. The optical emitter emits a first beam. The electronics module is mounted in either a first surface of the object or a second surface of a fixed structure disposed in opposition to the first surface. A reflector arrangement includes at least one reflective surface and is mounted in the other one of the first surface and the second surface. The at least one reflective surface receives the first beam and produces a second beam directed at the optical receiver. The second beam is substantially parallel to and offset from the first beam.

The invention comprises, in yet another form thereof, a method of detecting a position of a movable building structure, including mounting at least one reflective surface along a perimeter of the movable building structure. A first optical beam is transmitted towards the at least one reflective surface while the movable building structure is in a closed position. The at least one reflective surface is used to receive the first optical beam and produce therefrom a second optical beam that is substantially parallel to and offset from the first optical beam. The second optical beam is received while the movable building structure is in the closed position. Whether the movable building structure is in the closed position is determined based upon a status of the second optical beam.

An advantage of the present invention is that it is difficult for a would-be intruder to defeat. For example, because the final reflected beam is offset from and substantially parallel to the beam as originally emitted, it would be difficult for an intruder to insert a single planar mirror or sheet of paper between the door and the door frame to thereby intercept the emitted beam and reflect it toward the optical receiver.

Another advantage is that it is difficult for a would-be intruder to defeat by inserting an optical emitter between the door and the door frame to thereby emit an optical beam directly at the optical receiver. The emitted optical beam may carry a specific signal, and the electronic module may detect tampering by ascertaining that the beam received by the optical receiver does not carry a signal that has a certain relationship to the signal carried by the originally emitted beam. The signal may vary from electronic module to electronic module, or may vary with time, thereby making it difficult for a would-be intruder to reproduce the signal.

BRIEF DESCRIPTION OF THE DRAWINGS

The above mentioned and other features and objects of this invention, and the manner of attaining them, will become more apparent and the invention itself will be better understood by reference to the following description of embodiments of the invention taken in conjunction with the accompanying drawings, wherein.

Figure 1:
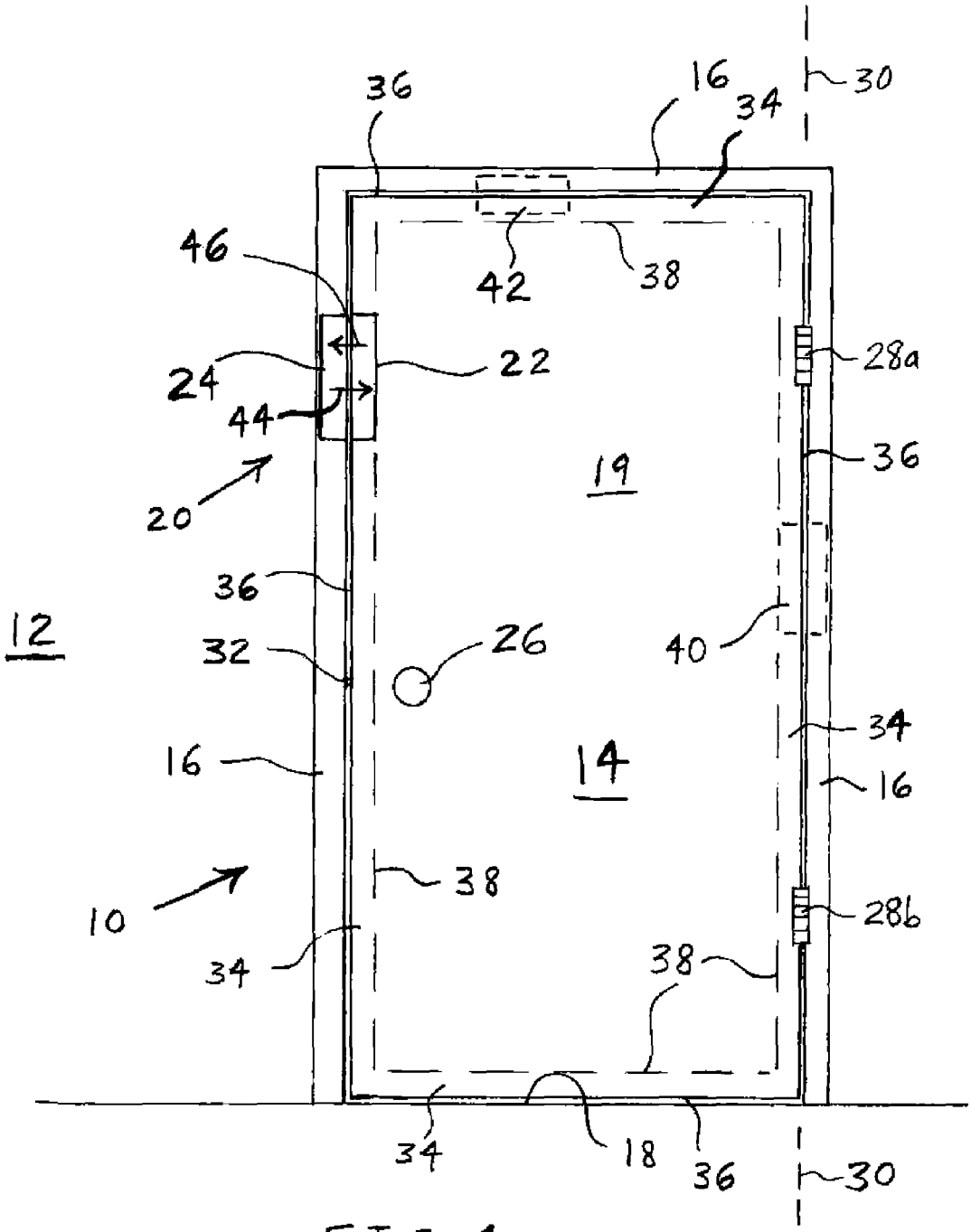
FIG. 1 is a plan view of one embodiment of a door assembly including an optical sensor apparatus of the present invention.

Corresponding reference characters indicate corresponding parts throughout the several views. Although the exemplification set out herein illustrates embodiments of the invention, in several forms, the embodiments disclosed below are not intended to be exhaustive or to be construed as limiting the scope of the invention to the precise forms disclosed.

DESCRIPTION OF THE PRESENT INVENTION

Referring now to the drawings and particularly to FIG. 1, there is shown one embodiment of a security assembly, in particular a door assembly 10, of the present invention for incorporation into a structure 12 such as a building, or, more particularly, a wall of a building. Door assembly 10 includes a movable building structure in the form of a door 14, which is surrounded by portions of structure 12, such as a door frame 16 and a floor surface 18. Door frame 16 and a floor surface 18 define a building opening 19 in the form of a doorway that door 14 covers when door 14 is in a closed position and that door 14 uncovers when door 14 is in an open position. An optical sensor apparatus 20 is mounted partially within door 14 and partially within door frame 16. More particularly, optical sensor apparatus 20 includes a reflector arrangement 22 and an electronics module 24 which may be mounted in opposing locations in association with door 14 and door frame 16, respectively.

Door 14 may be opened by manually grasping knob 26 and rotating door 14 about hinges 28*a*, 28*b*, i.e., about an axis 30 defined by hinges 28, as is well known. If door 14 is locked, i.e., if a latch 32 of door 14 is locked in a coupled state with frame 16, an intruder may nevertheless open door 14 by breaking hinges 28 and/or latch 32 away from frame 16, thereby allowing door 14 to be moved away from frame 16, as is also well known.

Reflector arrangement 22 may be mounted in a surface of door 14 at a location that is along a perimeter 34 of door 14. Perimeter 34 may be defined as an outer section of door 14 that is between outer edges 36 of door 14 and locations indicated generally by dashed line 38. Reflector arrangement 22 is shown mounted in a surface of perimeter 34 that is disposed opposite from hinges 28. However, reflector arrangement 22 could alternatively be mounted in a surface of perimeter 34 that is adjacent to hinges 28, as indicated at 40. Moreover, reflector arrangement 22 could be mounted not in a jamb, but rather in a surface of an upper portion of perimeter 34, as indicated at 42.

Regardless of in which location in the surface of perimeter 34 reflector arrangement 22 is mounted, electronic module 24 may be mounted in a surface of door frame 16 at a location that opposes the mounting location of reflector arrangement 22. Particularly, the relative mounting locations of reflector arrangement 22 and electronic module 24 may be such that an optical beam emitted by electronic module 24, as indicated by arrow 44, may be reflected back to an optical receiver of electronic module 24, as indicated by arrow 46. Reflector arrangement 22 may receive the emitted optical beam and reflect the beam a plurality of times such that the final beam directed back to the optical receiver is offset from and substantially parallel to the originally emitted beam, as indicated generally by the orientation and spacing of arrows 44, 46, and as described in more detail hereinbelow.

Figure 2:
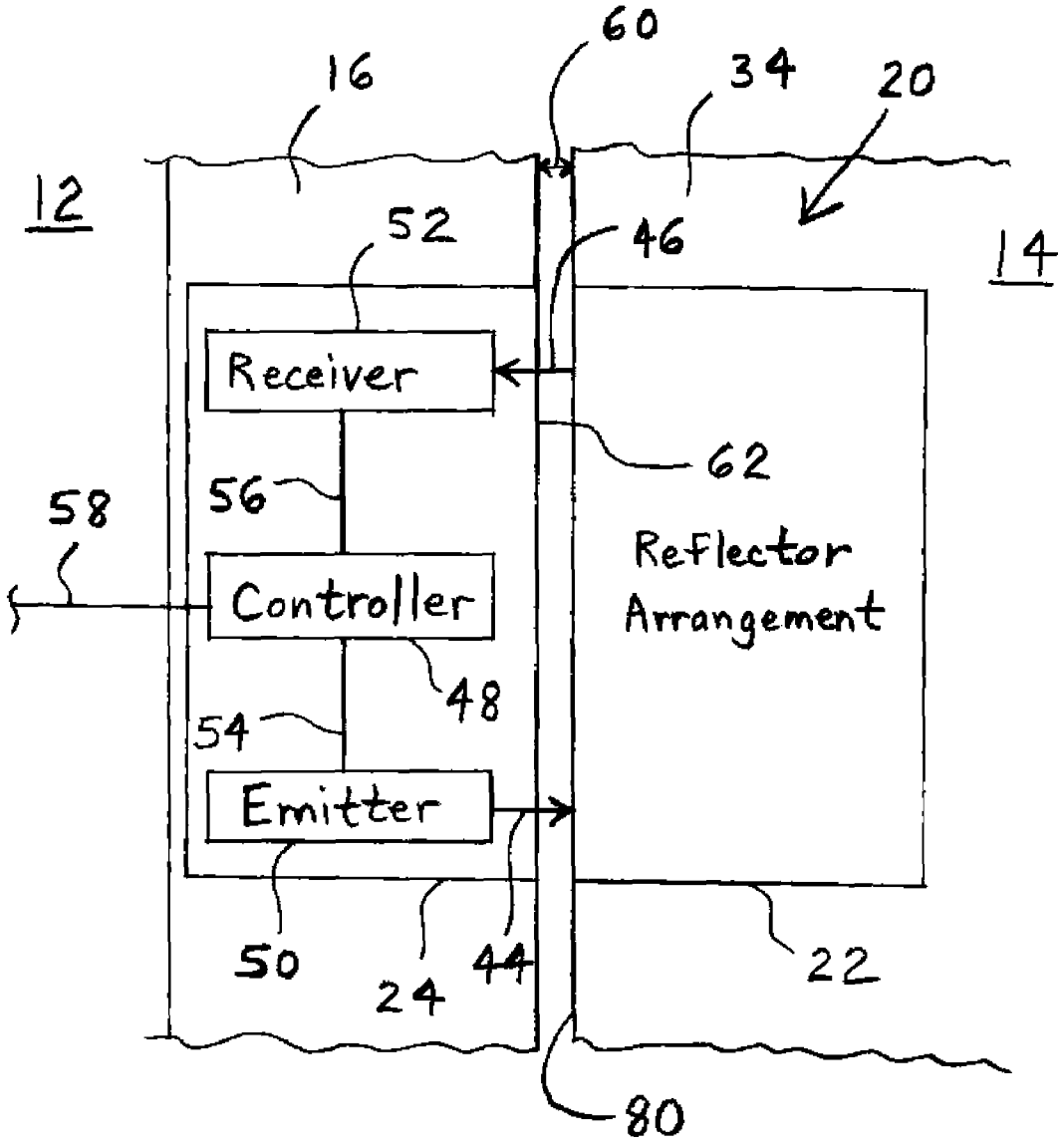
FIG. 2 is a block diagram of the optical sensor apparatus of FIG. 1.

As shown in FIG. 2, electronic module 24 may include a controller 48 that may be electrically connected to both optical emitter 50 and optical receiver 52, such as through lines 54, 56, respectively. Through line 58, controller 48 may be electrically connected to a control panel (not shown) or some other centralized device that is capable of causing some type of alarm signal or tamper signal to be issued in response to controller 48 determining that door 14 has been opened without authorization. A determination that door 14 has been opened may be made by controller 48 as a result of sensing that receiver 52 is not receiving an optical beam that corresponds to or that is related to the optical beam that is being emitted by emitter 50.

Emitter 50 may be in the form of a light-emitting diode (LED) that emits optical energy in the infrared range. Receiver 52 may be a photodiode or any other type of optical receiver that is capable of detecting optical energy of the frequency range emitted by emitter 50.

As is best illustrated in FIG. 2, an advantage of the present invention is that it would be difficult to defeat sensor apparatus 20 by inserting a single planar mirror or a sheet of paper into a gap 60 between door 14 and door frame 16. The difficulty of defeating sensor apparatus 20 in this way is at least partially attributable to originally emitted beam 44 and finally reflected beam 46 being substantially parallel, which makes it difficult for someone to replicate reflected beam 46 by inserting a single mirror or a sheet of paper into gap 60 at an orientation that is substantially perpendicular to emitted beam 44. In order to take advantage of the tamper-inhibiting characteristics of substantially parallel beams 44, 46, receiver 52 may be configured such that it may effectively receive beams only of the orientation of beam 46, i.e., beams that are substantially perpendicular to surface 62 of door frame 16.

In order to ensure that sensor apparatus 20 is operational despite receiver 52 effectively receiving beams only of the orientation of beam 46, emitted 44 beam may be polarized. Further, a polarizing filter may be included in receiver 52 for receiving the polarized reflected beam.

Another attribute of beams 44, 46 that makes defeating sensor apparatus 20 difficult is a lateral offset 64 (FIG. 3) between originally emitted beam 44 and finally reflected beam 46. More particularly, if offset 64 were to be reduced to a degree that it is substantially eliminated, then the angle at which emitted beam 44 would need to be reflected to reach receiver 52 in a single reflection would approach zero. Thus, it would become more feasible to defeat the sensor apparatus by inserting into gap 60 a sheet of paper or a single planar mirror that is narrower than gap 60, and by then orienting the mirror or paper slightly non-perpendicular to emitted beam 44 to thereby reflect beam 44 such that it may be received by receiver 52. However, due to offset 64, it may be practically impossible to insert paper or a small mirror into gap 60 and reflect emitted beam 44 such that it may be received by receiver 52.

Figure 3:
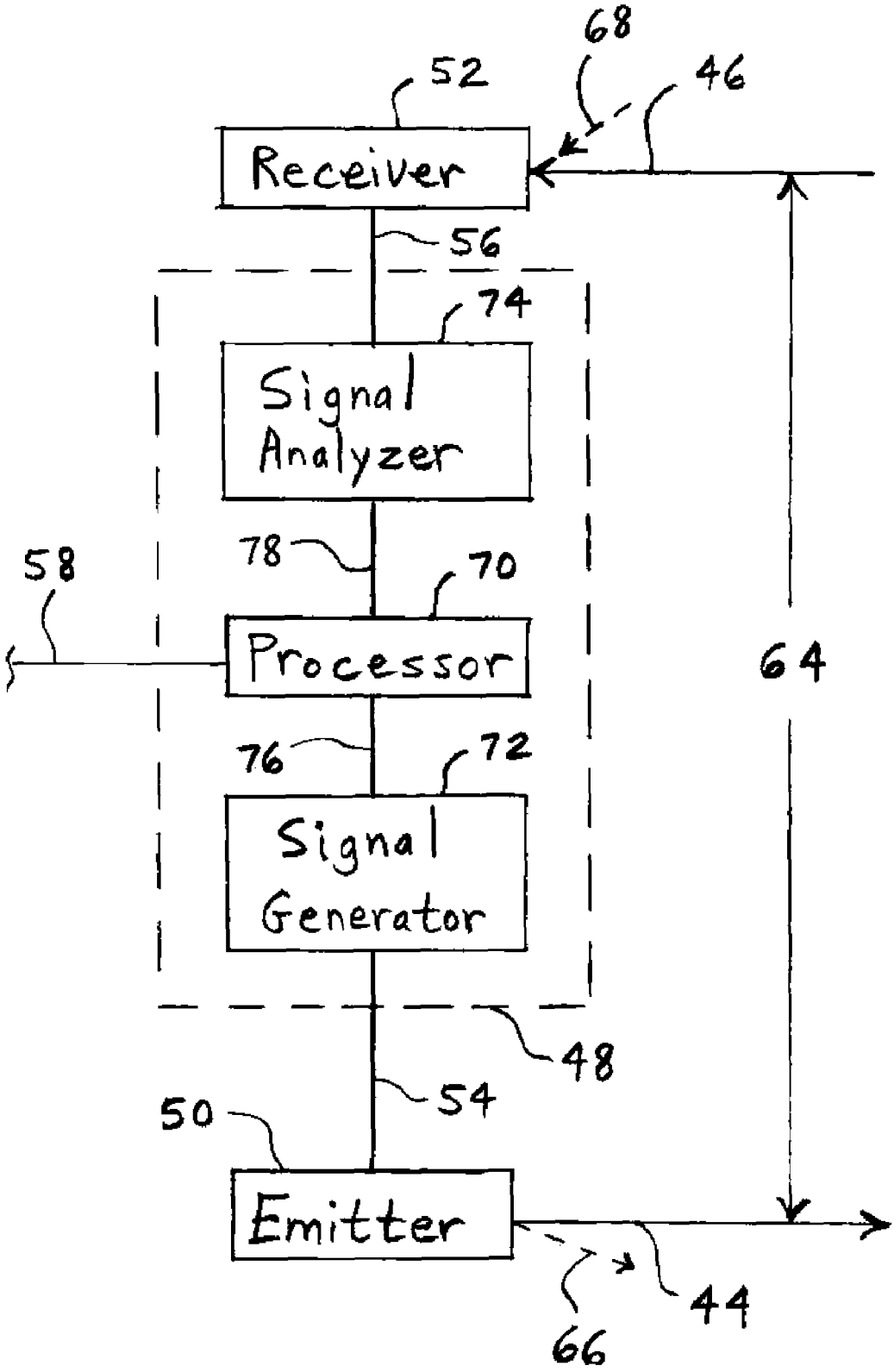
FIG. 3 is a block diagram of the electronic module of the optical sensor apparatus of FIG. 2.

Although in one embodiment beams 44, 46 are substantially parallel, it is also possible within the scope of the invention for the emitted beam to diverge from the receiver such as at a direction indicated by dashed line 66 in FIG. 3. In this case, the reflector arrangement would have a slightly different configuration to thereby produce a reflected beam 46 that is substantially perpendicular to surface 62. In addition, or alternatively, to the emitter producing a divergent beam such as at 66, the receiver may be configured to receive a finally reflected beam from a divergent direction, such as indicated by dashed line 68. In this case, the reflector arrangement would have another slightly different configuration to thereby produce a reflected beam that approaches receiver 52 at the angle indicated at 68. Divergent beams such as indicated at 66 and 68 may have the advantage of making the optical sensor apparatus still harder to defeat by use of paper or a mirror inserted into gap 60. That is, a divergent emitted beam 66 may be more difficult to reflect to the receiver than is emitted beam 44; and a divergent received beam 68 may be more difficult for a would-be intruder to produce than is beam 46.

One embodiment of controller 48 is shown in more detail in FIG. 3. Controller 48 may include a processor 70, such as a microprocessor, electrically connected to a signal generator 72 and to a signal analyzer 74 via respective lines 76, 78. Signal generator 72 may provide input to emitter 50 on line 54 specifying a unique identifying signal that is to be carried on emitted beam 44. As a result, reflected beam 46 may carry a substantially equivalent signal, or at least reflected beam 46 may carry a signal that has a certain relationship to the signal carried by beam 44. That is, the signal carried by beam 44 may undergo some transformation within reflector arrangement 22 before being carried by beam 46, but it may be a somewhat predictable transformation. For example, the signal carried by reflected beam 46 may be reduced in amplitude, and/or shifted in phase, as compared to the signal carried by emitted beam 44. Signal analyzer 74 may ascertain the signal carried by reflected beam 46 based upon communications that analyzer 74 receives from receiver 52. Signal analyzer 74 and/or processor 70 may compare the received signal carried by reflected beam 46 to the emitted signal carried by emitted beam 44. Signal analyzer 74 and/or processor 70 may thus determine, based upon a relationship between the received signal carried by reflected beam 46 and the emitted signal carried by emitted beam 44, whether reflected beam 46 is a product of emitted beam 44 and reflector arrangement 22. If it is determined that reflected beam 46 is a product of emitted beam 44 and reflector arrangement 22, then it can also be determined that reflector arrangement 22 and electronic module 24 are disposed in opposition to each other and that door 14 is in a closed position within door frame 16.

In order to prevent a would-be intruder from duplicating the reflected beam 46 and the signal carried thereby, the signal carried by emitted beam 44 may vary from electronic module to electronic module, or may vary with time, thereby making it difficult for the prospective intruder to determine what signal that processor 70 and/or signal analyzer 74 are expecting to receive at any point in time. It is further possible for emitted beam 44 to carry a signal having a security code that is embedded therein and that is randomly determined by processor 70 at any point in time. The would-be intruder would then need to ascertain and duplicate the security code in order to defeat the optical sensor apparatus.

In order to avoid interference from ambient light, such as from electric light bulbs, it is possible to oscillate emitted beam 44 at some particular frequency that gets passed on to reflected beam 46. Thus, this characteristic frequency may be used by processor 70 and/or signal analyzer 74 to distinguish reflected beam 46 from ambient light. Household current may be typically oscillated at about 60 Hz. In one embodiment, emitted beam 44 is oscillated at a frequency of about 1000 Hz in order that reflected beam 46 may be more easily distinguished from ambient light.

Figure 4A:
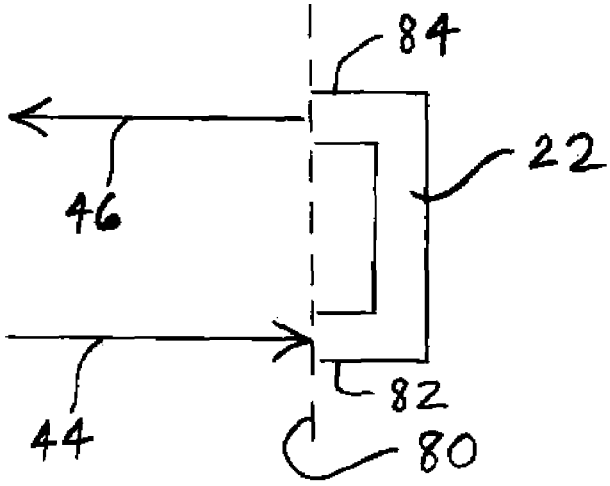
FIG. 4*a* is a schematic view of one embodiment of the reflector arrangement of the optical sensor apparatus of FIG. 2.
Figure 4B:
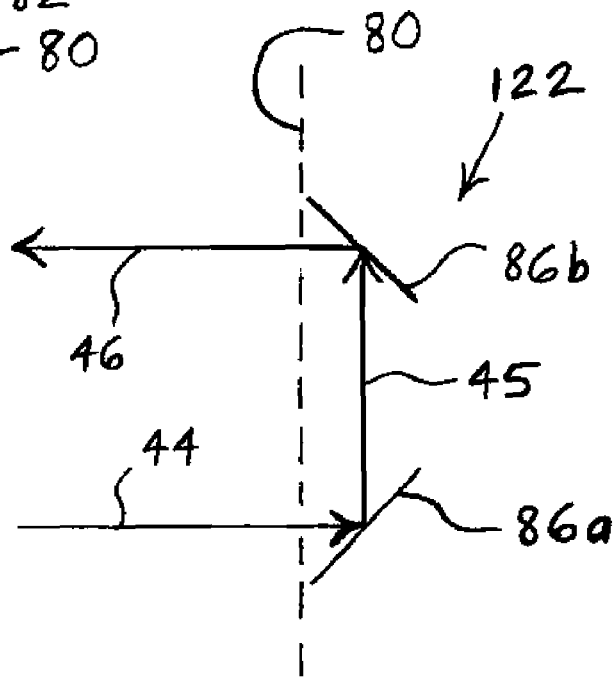
FIG. 4*b* is a schematic view of another embodiment of the reflector arrangement of the optical sensor apparatus of FIG. 2.
Figure 4C:
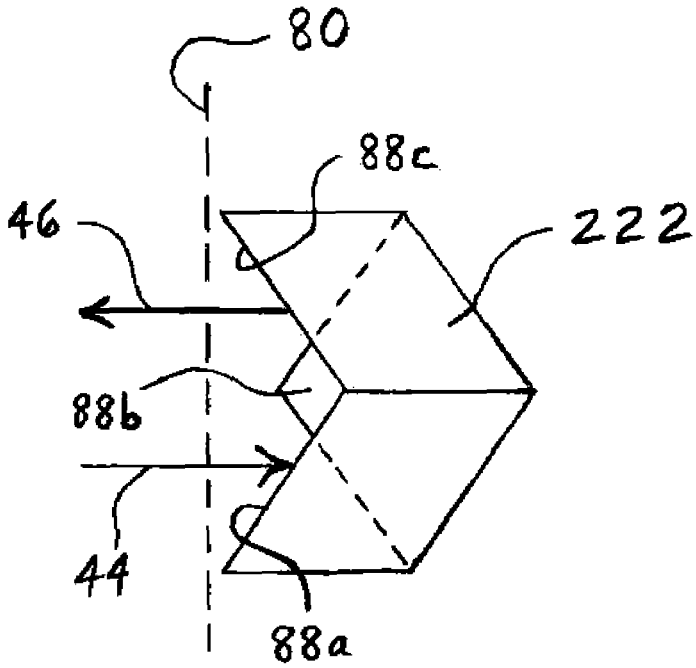
FIG. 4*c* is a schematic view of yet another embodiment of the reflector arrangement of the optical sensor apparatus of FIG. 2.

Exemplary embodiments of reflector arrangement 22 mounted in a surface 80 of perimeter 34 of door 14 are illustrated in FIGS. 4*a-c*. In the first embodiment illustrated in FIG. 4*a*, reflector arrangement 22 is in the form of a light pipe. Emitted beam 44 may be channeled from a first end 82 of the light pipe to a second end 84 via a plurality of internal reflections within the light pipe. Reflected beam 46 may emanate from second end 84 as shown. The light pipe may be embodied by an optical fiber, for example.

In the embodiment of FIG. 4*b*, a reflector arrangement 122 is in the form of two planar mirrors 86*a*, 86*b*. Mirror 86*a* may be oriented at an angle of about forty-five degrees relative to emitted beam 44 to thereby produce an intermediate reflected beam 45 that is oriented at an angle of forty-five degrees relative to mirror 86*a* and at an angle of ninety degrees relative to emitted beam 44. Similarly, mirror 86*b* may be oriented at an angle of about forty-five degrees relative to intermediate reflected beam 45 to thereby produce a final reflected beam 46 that is oriented at an angle of forty-five degrees relative to mirror 86*b* and at an angle of ninety degrees relative to surface 80 of perimeter 34.

In the third embodiment illustrated in FIG. 4*c*, a reflector arrangement 222 is in the form of a corner cube reflector. A corner cube reflector is characterized by three reflective planar surfaces, e.g., mirrors, 88*a*, 88*b*, 88*c*, each of which is oriented at a right angle to each of the other two surfaces. The corner cube reflector has the unique property that optical energy directed at any one of the reflective surfaces is reflected off of each of the three surfaces and is directed back in a direction that is opposite to the direction of the incoming optical energy. In each of the three embodiments illustrated in FIGS. 4*a-c*, final emitted beam 46 is parallel to and offset from originally emitted beam 44 after a plurality of sequential reflections by a plurality of reflective surfaces.

During use, after installation of optical sensor apparatus 20, door 14 is moved to a closed position and sensor apparatus 20 is armed, such as by a user via a control panel (not shown). In the armed state, sensor apparatus 20 may continually monitor the status of door 14. The user may disarm sensor apparatus 20 by entering a security code into the control panel, for example, perhaps within a grace time period after door 14 is opened. In the disarmed state, sensor apparatus 20 may no longer monitor door 14, or may refrain from issuing an alarm signal or tamper signal if door 14 is opened.

In the armed state, if door 14 is opened, such as by an intruder, then receiver 52 will no longer be in position to receive reflected beam 46. A determination that door 14 has been opened may be made by controller 48 based upon reflected beam 46 not being received by receiver 52 during a time period in which emitted beam 44 is still being emitted. Controller 48 may issue an alarm signal in response to the determination that door 14 has been opened without authorization.

If controller 48 determines that the signal being carried by the optical beam that is received by receiver does not have the expected relationship to the signal that is being carried by emitted beam 44, then controller 48 may conclude that someone may be tampering with sensor apparatus 20. That is, then controller 48 may conclude that someone may be unsuccessfully trying to defeat sensor apparatus 20 by attempting to simulate the reflected beam and accompanying signal that controller 48 expects to receive, and is directing the simulated beam and signal at receiver 52. Controller 48 may then issue a tamper signal, which may be, for example, in the form of a beeping sound that indicates to the user that investigation or maintenance may be needed.

Figure 5:
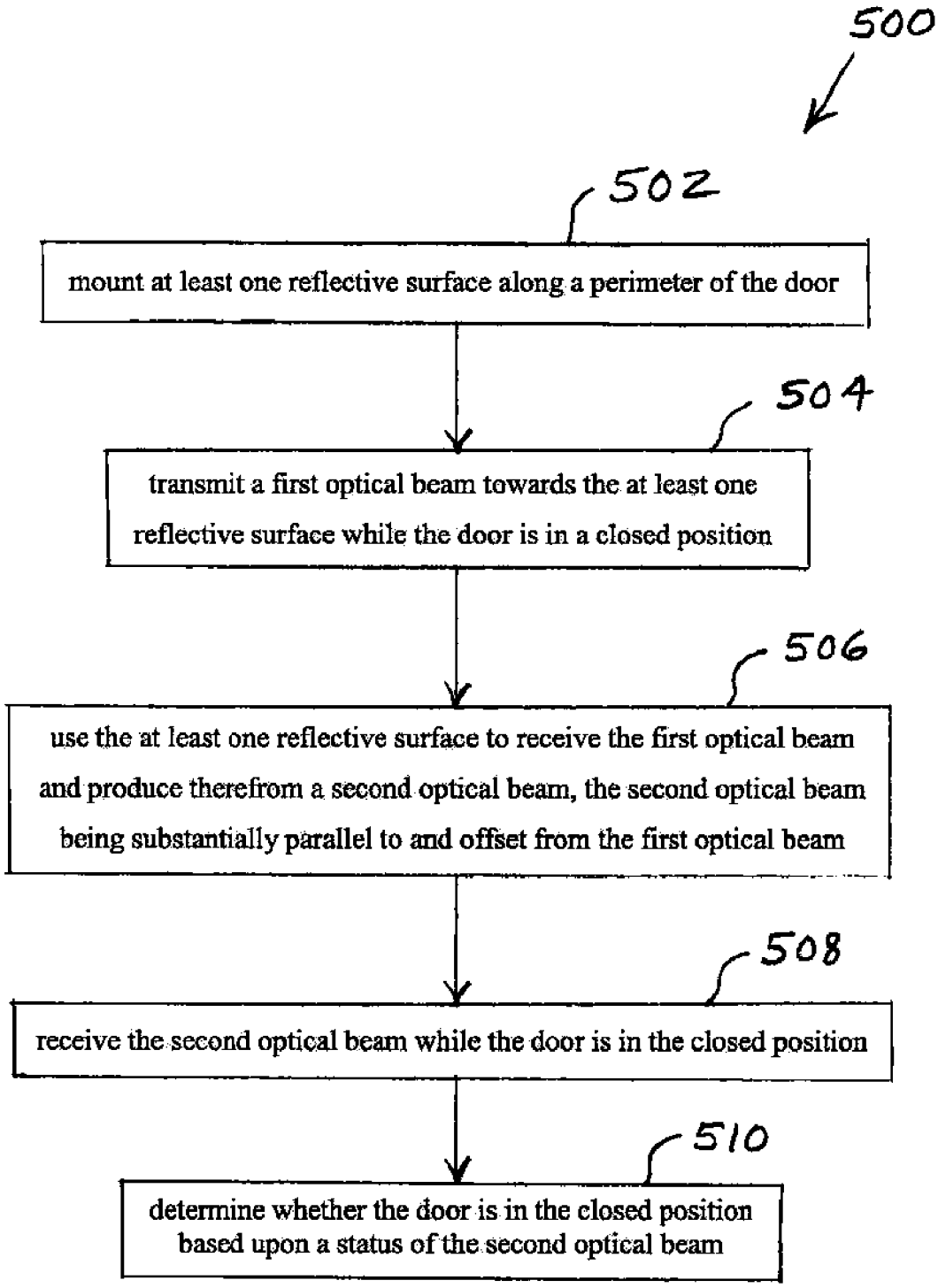
FIG. 5 is a flow chart of one embodiment of a method of the present invention for detecting a position of a door.

FIG. 5 illustrates one embodiment of a method 500 of the present invention for detecting the position of a door. However, it is to be understood that method 500 may be equally applicable for detecting the position of a window. In a first step 502, at least one reflective surface is mounted along a perimeter of a door. For example, any embodiment of reflector arrangement 22 disclosed herein includes at least one reflective surface and may be mounted along perimeter 34 of door 14. In a next step 504, a first optical beam is transmitted towards the at least one reflective surface while the door is in a closed position. In the embodiments disclosed herein, originally emitted beam 44 may be transmitted towards the at least one reflective surface of reflector arrangement 22 while door 14 is in the closed position illustrated in FIG. 1. In step 506, the at least one reflective surface is used to receive the first optical beam and produce therefrom a second optical beam, the second optical beam being substantially parallel to and offset from the first optical beam. For example, the at least one reflective surface of reflector arrangement 22 may receive originally emitted beam 44 and produce therefrom a final reflected beam 46 that is substantially parallel to and offset from beam 44. The offset may be as indicated at 64 in FIG. 3, for example. In a next step 508, the second optical beam is received while the door is in the closed position. That is, reflector arrangement 22 may be disposed opposite from electronics module 24 while door 14 is closed, and likewise receiver 52 may be in position to receive a final reflected beam 46 that may be produced by reflector arrangement 22 while door 14 is in the closed position. In a final step 510, it is determined whether the door is in the closed position based upon a status of the second optical beam. In a particular example, controller 48 may ascertain the status of an optical beam to be received by receiver 52. That is, controller 48 may ascertain whether receiver 52 is receiving and sensing an optical beam of any type. Further, if receiver 52 is indeed receiving and sensing an optical beam, controller 48 may ascertain whether the received optical beam carries a signal that has an expected relationship to a signal that may be carried by originally emitted beam 44. For example, controller 48 may expect the signal carried by reflected beam 46 to be substantially equivalent to the signal carried by emitted beam 44. As an alternative example, controller 48 may expect the signal carried by reflected beam 46 to have a certain drop in amplitude or a certain phase shift as compared to the signal carried by emitted beam 44. If it is found that the received optical beam does indeed carry a signal that has an expected relationship to a signal that is carried by originally emitted beam 44, then controller 48 may conclude that door 14 is in the closed position.

The present invention has been described herein as being applied to detecting the opening and closing of a hinged door that swings between an open position and a closed position. However, the present invention may be used to monitor any movable building structure that is movable between a closed position in which the movable building structure covers a building opening and an open position in which the movable building structure uncovers the building opening.

Figure 6:
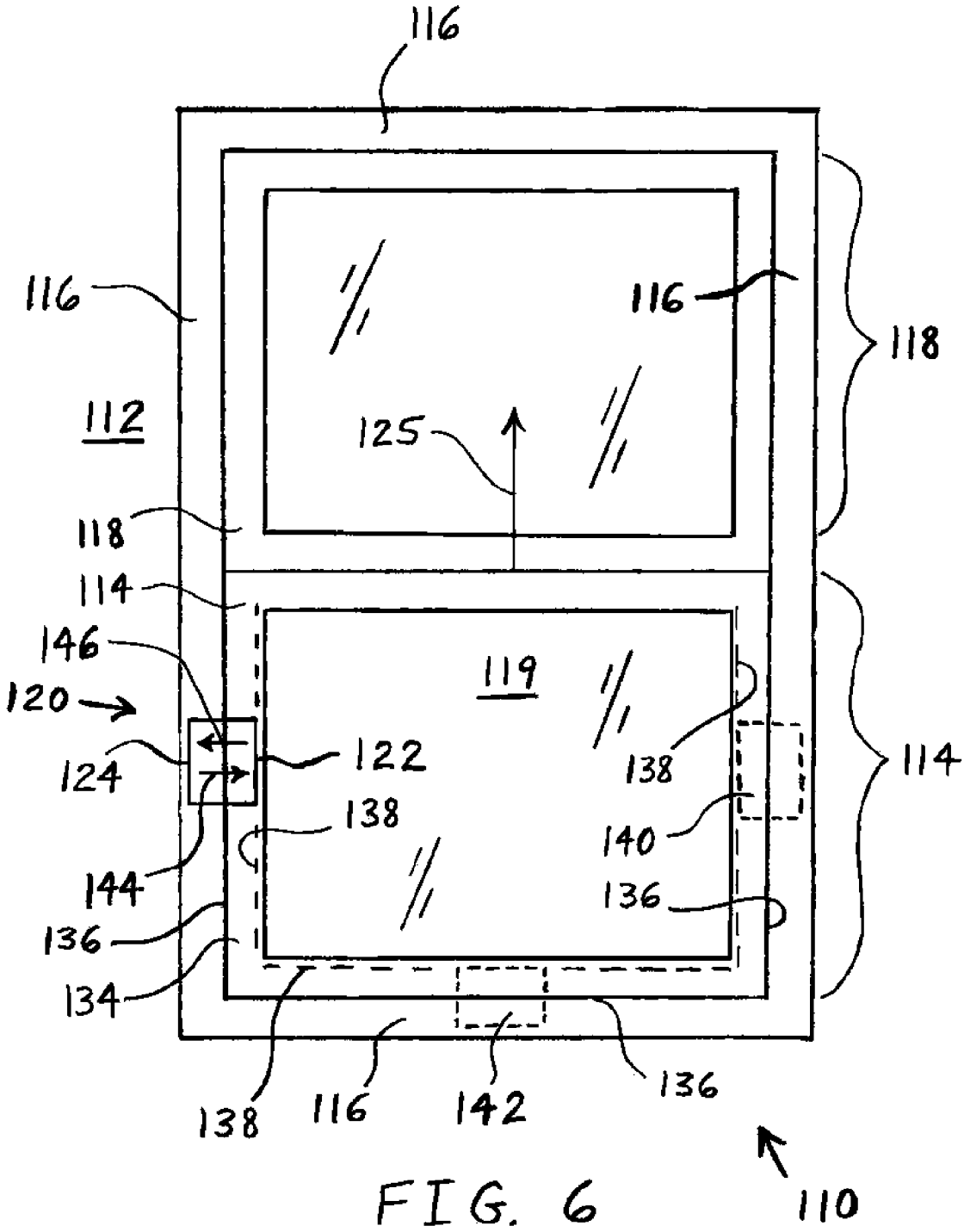
FIG. 6 is a plan view of one embodiment of a window assembly including an optical sensor apparatus of the present invention.

In FIG. 6, there is shown another embodiment of a security assembly of the present invention in the form of a window assembly 110 for incorporation into a structure 112 such as a building, or, more particularly, a wall of a building. Window assembly 110 includes a movable building structure in the form of a movable window sash 114, which is surrounded by portions of structure 112, such as a wall, a window frame 116 and a fixed window sash 118. Window frame 116 and a fixed window sash 118 define a building opening 119 in the form of a window opening that sash 114 covers when sash 114 is in a closed position and that sash 114 uncovers when sash 114 is in an open position. An optical sensor apparatus 120 is mounted partially within sash 114 and partially within window frame 116. More particularly, optical sensor apparatus 120 includes a reflector arrangement 122 and an electronics module 124 which may be mounted in opposing locations within sash 114 and window frame 116, respectively.

Sash 114 may be opened by manually grasping sash 114 and sliding sash 114 in an upward direction 125, as is well known. Imaginary planes defined by sashes 114, 118 may be parallel to each other and displaced from each other in a direction into the page of FIG. 6. To at least partially open sash 114, and thereby at least partially uncover opening 119, sash 114 may be slid in direction 125 in tracks (not shown) in frame 116 such that sash 114 at least partially overlaps sash 118 in a direction into the page of FIG. 6, as is also well known.

Reflector arrangement 122 may be mounted in a surface of sash 114 at a location that is along a perimeter 134 of sash 114. Perimeter 134 may be defined as an outer section of sash 114 that is between outer edges 136 of sash 114 and locations indicated generally by dashed line 138. Reflector arrangement 122 is shown mounted in a vertically-oriented surface of perimeter 134. However, reflector arrangement 122 could alternatively be mounted in the portion of the surface of perimeter 134 that is on the other end of sash 114, as indicated at 140. Moreover, reflector arrangement 122 could be mounted not in a vertically-oriented surface, but rather in a horizontally-oriented surface of perimeter 34 that is disposed opposite the window sill, as indicated at 142.

Regardless of in which location in the surface of perimeter 134 reflector arrangement 122 is mounted, electronic module 124 may be mounted in a surface of window frame 116 at a location that opposes the mounting location of reflector arrangement 122. Particularly, the relative mounting locations of reflector arrangement 122 and electronic module 124 may be such that an optical beam emitted by electronic module 124, as indicated by arrow 144, may be reflected back to an optical receiver of electronic module 124, as indicated by arrow 146. Reflector arrangement 122 may receive the emitted optical beam and reflect the beam a plurality of times such that the final beam directed back to the optical receiver is offset from and substantially parallel to the originally emitted beam, as indicated generally by the orientation and spacing of arrows 144, 146, and as described in more detail hereinabove with regard to FIGS. 1-5.

The present invention has been primarily described herein in connection with sensing the opening of a hinged door that swings between an open position and a closed position. However, it is to be understood that the features of the present invention described herein may be equally applicable to sensing the opening of any movable building structure, such as a window or a sliding door, that translates between an open position and a closed position.

The present invention has been described herein as including a reflector arrangement and an electronic module mounted at opposing locations within the door and the door frame, respectively. However, it is to be understood that it is within the scope of the present invention for the reflector arrangement to be mounted within the door frame and the electronic module to be mounted within the door. Moreover, it is also within the scope of the present invention for one of the reflector arrangement and the electronic module to be mounted within a bottom edge of the door and the other to be mounted at an opposing location within the floor surface.

The reflector arrangement of the present invention has been described herein as being mounted in an outer edge of a door so as to receive and reflect optical signals that are oriented parallel to a plane defined by the door. However, it is also possible for the reflector arrangement to be mounted within one of the two large opposite surfaces of the door, albeit along the perimeter of the door such that the reflector arrangement is covered, when the door is closed, by a portion of the door frame that is parallel to the plane defined by the door. In this way, the reflector arrangement would receive and reflect optical signals that are oriented perpendicular to a plane defined by the door.

The electronics module of the present invention has been described herein as being disposed in a fixed building structure, such as a door frame or a window frame. However, it is to be understood that it is also possible within the scope of the invention for both the electronics module and the reflector arrangement to be disposed in opposing surfaces of two movable structures. For example, the electronics module and the reflector arrangement may be disposed in opposing surfaces of a pair of French doors or a pair of French windows, both of which are hinged at opposite outside edges, and which open in the middle between the two movable structures.

While this invention has been described as having an exemplary design, the present invention may be further modified within the spirit and scope of this disclosure. This application is therefore intended to cover any variations, uses, or adaptations of the invention using its general principles.

What is claimed is:

1. A security assembly, comprising:

a first building structure at least partially defining a building opening, said first building structure having a first surface;

a movable building structure movable between a closed position in which said movable building structure covers said opening and an open position in which said movable building structure uncovers said opening, said movable building structure having a perimeter with a second surface disposed in opposition to said first surface when said movable building structure is in the closed position; and an optical sensor apparatus including:

an electronics module mounted in association with one of said first surface and said second surface, said electronics module having an optical emitter and an optical receiver, said optical emitter being configured to emit a first beam, the first beam diverging from said optical receiver; and a reflector arrangement mounted in association with an other of said first surface and said second surface, said reflector arrangement being configured to provide a plurality of sequential reflections of the first beam to thereby produce a second beam directed at said optical receiver.

2. The door assembly of claim 1 wherein the second beam approaches said optical receiver from a divergent direction.

3. The door assembly of claim 2 wherein the second beam is offset from the first beam.

4. The door assembly of claim 2 wherein said divergent direction is at an angle of greater than thirty degrees relative to a direction perpendicular to the one surface.

5. The door assembly of claim 1 wherein said reflector arrangement comprises a plurality of planar mirrors.

6. The door assembly of claim 1 wherein said first beam diverges from a direction perpendicular to the one surface at an angle of greater than twenty degrees.

7. The door assembly of claim 1 wherein a first signal carried by the first beam is randomly determined by said electronics module.

8. The door assembly of claim 1 wherein the first beam is at an obtuse angle relative to an imaginary line between the optical emitter and the optical receiver.

9. A security sensor apparatus for sensing movement of an object, said sensor apparatus comprising:

an electronics module including an optical emitter and an optical receiver, said optical emitter being configured to emit a first beam oscillated at a frequency approximately between 200 Hz and 2000 Hz, said electronics module being configured to be mounted in association with one of a first surface of the object and a second surface of a fixed structure disposed in opposition to the first surface; and a reflector arrangement including at least one reflective surface, said reflector arrangement being configured to be mounted in association with an other of the first surface and the second surface, said at least one reflective surface being configured to receive the first beam and produce a second beam directed at said optical receiver, the second beam being substantially parallel to and offset from the first beam.

10. The apparatus of claim 9 wherein the object comprises a door, said electronics module being configured to be mounted in one of a perimeter surface of the door and a surface of a door frame, said reflector arrangement being configured to be mounted in an other of the perimeter surface of the door and the surface of the door frame.

11. The apparatus of claim 9 wherein the first beam carries a first signal and the second beam carries a second signal, said electronics module including a controller connected to said optical receiver, said controller being configured to determine a position of the object based upon a status of the second signal, and based upon the second beam being oscillated at a frequency approximately equal to the frequency at which the first beam is oscillated.

12. The apparatus of claim 9 wherein said reflector arrangement comprises a plurality of planar mirrors.

13. The apparatus of claim 9 wherein said electronics module is configured to compare a first signal carried by the first beam to a second signal carried by the second beam, the first signal being randomly determined by said electronics module.

14. A method of detecting a position of a movable building structure, said method comprising the steps of:

mounting at least three reflective surfaces along a perimeter of the movable building structure;

transmitting a first optical beam towards a first of said at least three reflective surfaces while the movable building structure is in a closed position;

reflecting the first optical beam off of the first reflective surface, a second of the reflective surfaces, and a third of the reflective surfaces in sequence to thereby produce a second optical beam, said second optical beam being substantially parallel to and offset from the first optical beam;

receiving the second optical beam while the movable building structure is in the closed position; and determining whether the movable building structure is in the closed position based upon a status of the second optical beam.

15. The method of claim 14 wherein the first optical beam carries a randomly determined first signal and the second optical beam carries a second signal, said determining step being dependent upon both the first signal and the second signal.

16. The method of claim 15 wherein said determining step is dependent upon a relationship between the first signal and the second signal.

17. The method of claim 15 comprising the further step of issuing a tamper signal dependent upon a relationship between the first signal and the second signal.

18. The method of claim 14 wherein said at least three reflective surfaces comprises a corner cube reflector.

19. The method of claim 14 wherein said at least three reflective surfaces comprises a light pipe.

20. The method of claim 14 wherein said at least three reflective surfaces comprises an optical fiber.

* * * * *